US007784555B2

(12) United States Patent
Pahila

(10) Patent No.: US 7,784,555 B2
(45) Date of Patent: Aug. 31, 2010

(54) HORIZONTAL SIDEWALL FIRE PROTECTION SPRINKLERS

(75) Inventor: Oliver S. Pahila, Mahopac, NY (US)

(73) Assignee: The Reliable Automatic Sprinkler Co., Inc., Elmsford, NY (US)

( * ) Notice: Subject to any disclaimer, the term of this patent is extended or adjusted under 35 U.S.C. 154(b) by 0 days.

(21) Appl. No.: 10/974,397

(22) Filed: Oct. 26, 2004

(65) Prior Publication Data

US 2006/0086510 A1 Apr. 27, 2006

(51) Int. Cl.
*A62C 37/08* (2006.01)
*A62C 37/36* (2006.01)

(52) U.S. Cl. ..... 169/37; 169/42

(58) Field of Classification Search ..... 169/37, 169/40, 42, 19, 16, 38, 39, 41
See application file for complete search history.

(56) References Cited

U.S. PATENT DOCUMENTS

| | | | | | |
|---|---|---|---|---|---|
| 4,296,815 | A | | 10/1981 | Mears | 169/37 |
| 4,296,816 | A | | 10/1981 | Fischer | 169/37 |
| 4,417,626 | A | * | 11/1983 | Hansen | 169/37 |
| 4,660,648 | A | * | 4/1987 | Zen | 169/38 |
| 4,662,455 | A | * | 5/1987 | Simons | 169/37 |
| 4,987,957 | A | | 1/1991 | Galaszewski | 169/37 |
| 5,020,601 | A | * | 6/1991 | Retzloff et al. | 169/37 |
| 5,447,338 | A | | 9/1995 | Kikuchi | 285/46 |
| 5,722,599 | A | | 3/1998 | Fries | 239/504 |
| 5,727,737 | A | | 3/1998 | Bosio et al. | 239/504 |
| 5,810,263 | A | | 9/1998 | Tramm | 239/518 |
| 6,082,463 | A | * | 7/2000 | Ponte | 169/41 |
| 6,098,718 | A | * | 8/2000 | Sato | 169/37 |
| 6,374,919 | B1 | | 4/2002 | Neill | 169/37 |
| 6,840,329 | B2 | * | 1/2005 | Kikuchi et al. | 169/37 |
| 2002/0129946 | A1 | | 9/2002 | Retzloff et al. | 169/37 |
| 2003/0222155 | A1 | | 12/2003 | Neil et al. | 239/208 |

OTHER PUBLICATIONS

"Series TY-L—5.6 K-Factor Horizontal Sidewall Sprinklers Standard Response, Standard Coverage," Tyco Fire Products, Lansdale, PA, Jan. 2003.

(Continued)

*Primary Examiner*—Davis Hwu
(74) *Attorney, Agent, or Firm*—Fitzpatrick, Cella, Harper & Scinto

(57) ABSTRACT

A horizontal sidewall fire protection sprinkler is provided, including a deflector having a vertical face, transverse to the fluid flow from the output orifice, and a horizontal shelf positioned above and perpendicular to the vertical face. A portion of the horizontal shelf extends in the fluid flow direction by a first length, with respect to the vertical face, and this first length is less than about half of a total length of the horizontal shelf in the fluid flow direction. The sprinkler is installed in a support cup having a raised mounting platform configured to receive the sprinkler body and a cylindrical outer surface, with a front edge in a fluid flow direction, and a back edge. The mounting platform of the support cup is closer to the front edge of the support cup in an axial direction thereof than to the back edge.

7 Claims, 8 Drawing Sheets

OTHER PUBLICATIONS

"Series TY-FRB—5.6 and 8.0 K-Factor Extended Coverage Horizontal Sidewall Sprinklers Quick & Standard Response (Light Hazard)." Tyco Fire Products, Lansdale, PA, Jan. 2003.

"Model SW-20 and SW-24—11.2 K-Factor Extended Coverage Ordinary Hazard Horizontal Sidewall Sprinklers (Standard Response)." Tyco Fire Products, Lansdale, PA, Apr. 2003.

"Model CHEC—8.0 K-Factor Concealed Horizontal Extended Coverage Quick Response Light Hazard, Sidewall Sprinklers." Tyco Fire Products, Lansdale, PA, Apr. 2004.

"Series LFII Residential Horizontal Sidewall Sprinklers 4.2 K-Factor." Tyco Fire Products, Lansdale, PA, Apr. 2004.

* cited by examiner

HORIZONTAL SIDEWALL FIRE PROTECTION SPRINKLERS

BACKGROUND OF THE INVENTION

1. Field of the Invention

The present invention relates to horizontal sidewall fire protection sprinklers, including those having a deflector with a rearwardly positioned horizontal shelf, which reduces the overall length of the sprinkler to provide a low-profile configuration. Such sprinklers may also be mounted in a supporting cup having a raised platform, with an escutcheon and cover, to provide a concealed configuration with improved sensitivity.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb, and may include a latching mechanism.

Certain conventional sprinklers have a pair of arms that extend from the base portion and meet at a hub portion to form a frame. The hub portion is spaced apart from the output orifice of the base portion and is aligned with a longitudinal axis thereof. The hub portion may have a set-screw configured to apply a pretension force to the thermally-responsive element and latching mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. Alternatively, a sprinkler may be mounted on a wall, a certain distance below the ceiling, which is referred to as a "horizontal sidewall" configuration. Horizontal sidewall sprinklers have an output orifice that is oriented so that the fluid is output horizontally and sprays onto an area to be protected in front of the sprinkler. The area to be protected may extend across an entire room, in which case the relevant fire protection standards, e.g., Underwriters' Laboratories® Standard 1626, require the fluid flow to reach a particular height on the four walls surrounding the coverage area, among other requirements. Horizontal sidewall sprinklers are particularly useful in applications in which overhead piping is not easily installed, e.g., in residential applications.

U.S. Pat. No. 6,374,919 shows a horizontal sidewall sprinkler having a deflector with a horizontal shelf. The forwardly-extended portion of the shelf (approximately 0.6 inches) is greater than half the total length (approximately 1.0 inches) thereof. The sprinkler is mounted in a cup with a cover. The cup is mounted in a cavity in the wall such that the flange of the cup is flush with the wall surface. A cover is mounted on the flange so as to leave a gap therebetween to allow air flow to enter.

Technical bulletin "Series LFII Residential Horizontal Sidewall Sprinklers 4.2 K-factor" (Tyco Fire Products, Lansdale, Pa., April 2004) shows a horizontal sidewall sprinkler having a deflector with a horizontal shelf. The shelf is perpendicular to the frame arms and is approximately 0.7 inches in length, as measured from front edge to back edge near the center (the front edge faces away from the output orifice). The shelf appears to extend at a slightly upward angle with respect to the horizontal axis and has a protrusion in the center of the forward edge. The shelf extends approximately 0.43 inches beyond the major vertical surface of the deflector (i.e., the surface transverse to the fluid flow). Thus, the forwardly-extended portion of the shelf is approximately 61% of the total length thereof.

Technical bulletin "Series TY-L—5.6 K-factor Horizontal Sidewall Sprinklers, Standard Response, Standard Coverage" (Tyco Fire Products, Lansdale, Pa., January 2003) shows a horizontal sidewall sprinkler having a deflector with a horizontal shelf. The shelf is parallel to the frame arms and is approximately 0.66 inches in length, as measured from front edge to back edge near the center (the front edge facing away from the output orifice). The shelf extends approximately 0.37 inches beyond the major vertical surface of the deflector (i.e., the surface transverse to the fluid flow). Thus, the forwardly-extended portion of the shelf is approximately 56% of the total length thereof.

Technical bulletin "Model CHEC—8.0 K-factor Concealed Horizontal Extended Coverage Quick Response Light Hazard, Sidewall Sprinklers" (Tyco Fire Products, Lansdale, Pa., April 2004) shows a horizontal sidewall sprinkler having a deflector with a horizontal shelf. The shelf is perpendicular to the frame arms and is approximately 0.880 inches in length, as measured from front edge to back edge near the center (the front edge facing away from the output orifice). The shelf has a protrusion in the center of the forward edge. The shelf extends approximately 0.56 inches beyond the major vertical surface of the deflector (i.e., the surface transverse to the fluid flow). Thus, the forwardly-extended portion of the shelf is approximately 63.6% of the total length thereof. This document also shows the sprinkler mounted in a support cup assembly with a cover. The sprinkler is positioned in the support cup such that a frangible glass bulb is completely enclosed within the support cup and does not extend beyond the wall surface (i.e., the "retainer flange mounting surface"). The hub at which the frame arms meet is positioned so that a portion of the hub falls within the gap between the flange and the cover (i.e., within the "preset gap").

Some conventional horizontal sidewall sprinklers extend from the wall such that their structure is visible, which is not aesthetically pleasing. Moreover, the extended structure tends to invite improper use of the sprinkler, for example to hang clothing or other items. Such improper use is undesirable, as it may render the sprinkler inoperable or cause unintended activation. Some conventional horizontal sidewall sprinklers are mounted in a support cup with a cover, such that the thermally-responsive element is positioned completely within the support cup. This arrangement tends to reduce air flow across the thermally-responsive element and correspondingly reduces the sensitivity of the sprinkler. Moreover, such configurations often include deflector shelves that extend significantly beyond the vertical surface of the deflector and require covers that extend further from the wall.

SUMMARY OF THE INVENTION

In one aspect, the present invention provides a horizontal sidewall fire protection sprinkler including a body having an output orifice, a seal cap to seal a flow of fluid from the output orifice, and a thermally-responsive element positioned to releasably retain the seal cap. The sprinkler also includes a deflector having a substantially vertical face that is transverse to a direction of fluid flow from the output orifice, and a substantially horizontal shelf positioned above and substantially perpendicular to the vertical face. A portion of the horizontal shelf extends in the direction of fluid flow by a first length, with respect to the vertical face, and this first length is less than about half of a total length of the horizontal shelf in the fluid flow direction.

Embodiments of the present invention may include one or more of the following features. The first length may be about 35% or less of the total length of the horizontal shelf. The horizontal shelf may include an inclined portion on a forward edge thereof, which may extend across a majority of a width of the horizontal shelf. The inclined portion may be substantially planar.

The vertical face of the deflector may have notches that are oriented about an opening formed in the deflector, between the vertical face and an underside of the horizontal shelf. The vertical face of the deflector may include a folded portion at a bottom edge thereof. The folded portion may form an angle of about 2° with respect to the vertical face. The vertical face of the deflector may have a substantially rectangular opening near a bottom edge thereof.

The horizontal sidewall fire protection sprinkler also may include a support cup having a substantially cylindrical outer surface, a front edge in the direction of fluid flow, and a back edge. The support cup may have a raised mounting platform in which the body is mounted. The mounting platform may be closer to the front edge of the support cup in an axial direction thereof than to the back edge. A distance between the mounting platform and the back edge of the support cup in the axial direction may be at least about twice a distance between the mounting platform and the front edge of the support cup. The sprinkler also may include an escutcheon having a substantially cylindrical outer surface configured to fit inside the outer surface of the support cup. A cover may be attached to a mounting flange of the escutcheon.

In other embodiments, the sprinkler may include a support cup in which the sprinkler body is mounted. The support cup may have an outer surface configured to be positioned within a cavity in a wall, and an escutcheon with an outer surface configured to fit inside the outer surface of the support cup and a flange on a front edge of the outer surface (the flange being configured to mount against a surface of the wall).

In another aspect, the present invention provides a fire protection sprinkler including a body with an output orifice sealed with a seal cap, a thermally-responsive element positioned to releasably retain the seal cap, and a deflector positioned a distance from the output orifice in a direction of fluid flow. The sprinkler further includes a support cup having a raised mounting platform configured to receive the body. The support cup has a substantially cylindrical outer surface, a front edge in the fluid flow direction, and a back edge. The mounting platform is closer to the front edge of the support cup in an axial direction thereof than to the back edge of the support cup.

Embodiments of the present invention may include one or more of the following features. An escutcheon may be provided having a substantially cylindrical outer surface configured to fit inside the outer surface of the support cup. A cover may be attached to a mounting flange of the escutcheon. A distance between the mounting platform and the back edge of the support cup in the axial direction may be at least about twice a distance between the mounting platform and the front edge of the support cup.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
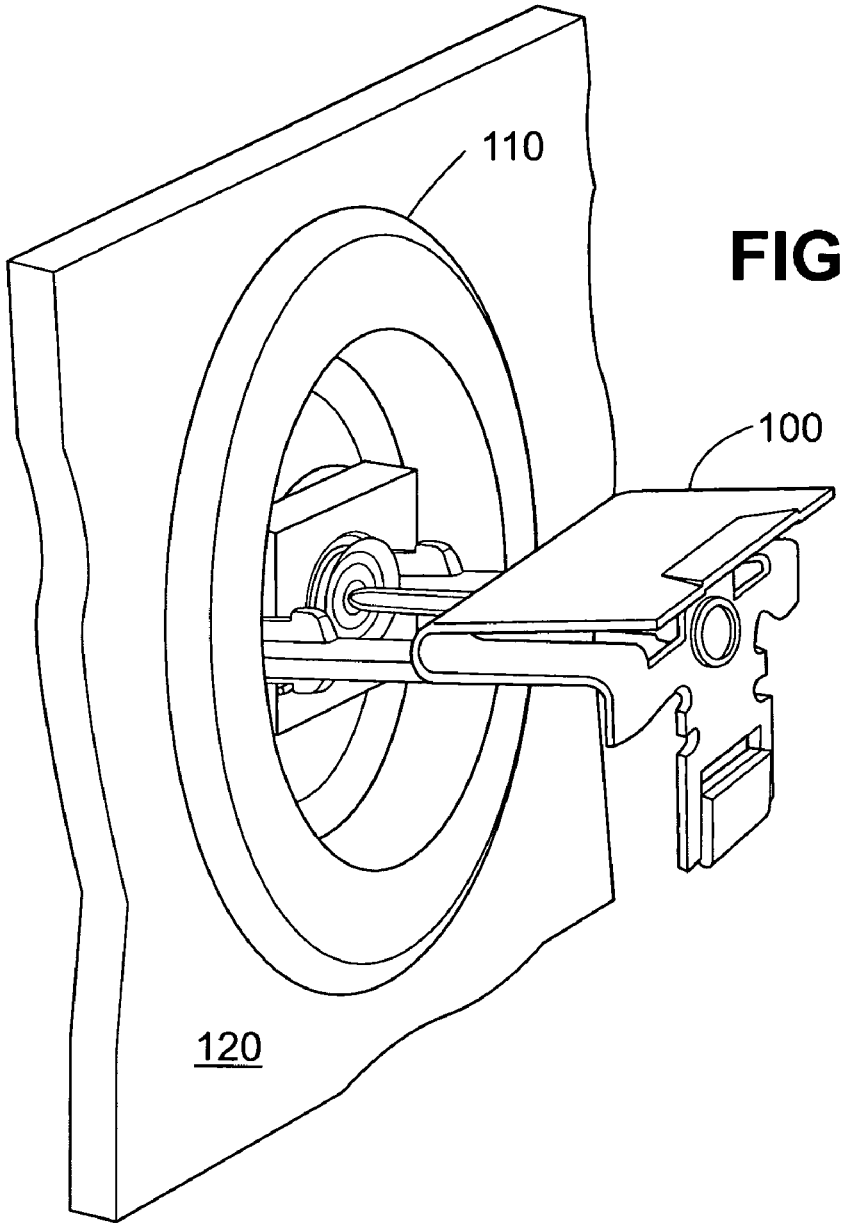
FIG. 1 is a perspective view of the horizontal sidewall sprinkler installed in a support cup assembly of a non-concealed configuration.

As shown in FIG. 1, a horizontal sidewall sprinkler 100 in accordance with the present invention may be installed in a non-concealed configuration in a support cup assembly 110. The support cup 110 assembly is mounted in a wall 120, a predetermined distance below a ceiling. The sprinkler 100 is connected to a conduit (not shown) behind the wall 120 that provides pressurized fire-extinguishing fluid, such as water.

Figure 2:
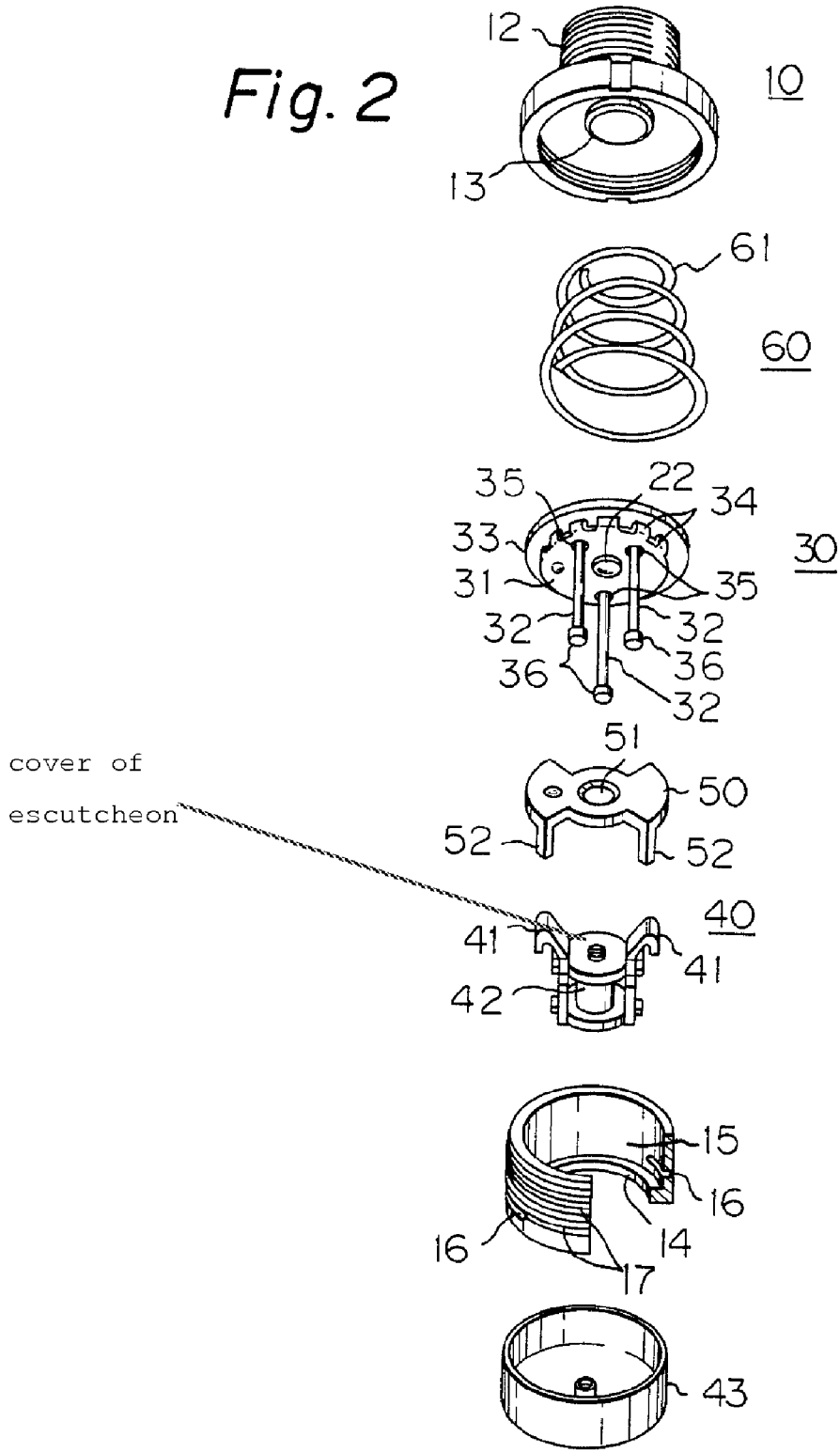
FIG. 2 is a top view of the horizontal sidewall sprinkler.
Figure 3:
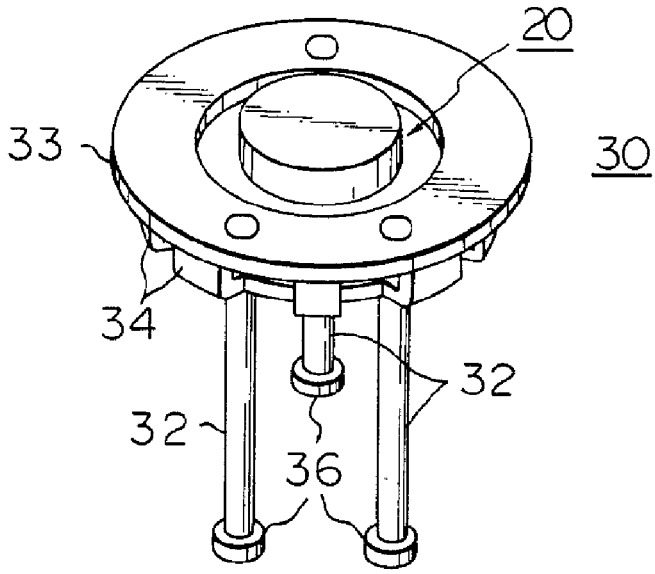
FIG. 3 is a side sectional view of the horizontal sidewall sprinkler.

As shown in the top view of FIG. 2 and side section view of FIG. 3, the sprinkler 100 has two frame arms 205 that extend from a threaded base portion 210 and meet at a hub 215 (see FIG. 3), on which a deflector 220 is mounted. The deflector 220 has a horizontal shelf 225 and a vertical face 230, approximately perpendicular to the shelf 225. The fire-extinguishing fluid flows both over the top of and under the shelf 225.

The sprinkler 100 also has a thermally-responsive element, such as for example a frangible bulb 235, positioned between the hub 215 and a seal cap 240 to hold the seal cap in place over the output orifice 245. The bulb 235 is designed to break at a predetermined temperature, thereby releasing the seal cap 240 (due to the pressure of the fluid in the conduit) and allowing the fluid to be output from the orifice 245. The output orifice may have a diameter of, for example, ½ inch NPT (national pipe thread). The sprinkler may have a K-factor of, for example, 4.4, which is defined by $K=Q/\sqrt{p}$, where Q is the flow rate in gallons per minute and p is the residual pressure at the inlet of the sprinkler in pounds per square inch. Of course, other types of thermally-responsive elements may be used, including but not limited to, for example, a fusible link assembly, or a sensor, strut, and lever assembly.

The deflector shelf 225 has an upwardly-angled, inclined portion 250 on the front edge, i.e., the edge facing away from the output orifice 245. The inclined portion 250 provides an upward vertical deflection to the fluid flow, which in turn imparts an upward trajectory to a portion of the fluid flow. This upward trajectory results in the fluid reaching a higher point on the opposite wall, which helps the sprinkler meet opposite wall wetting height requirements. The incline 250 is substantially planar and extends across a large portion of the width of the shelf 225. This configuration helps provide a uniform upward deflection to a significant portion of the output stream without imparting substantial additional horizontal deflection.

As shown in FIG. 3, the deflector 220 is attached to the end of the hub 215 via a fastener that passes though an opening 255 in the vertical face 230 of the deflector 220. In the embodiment shown, the deflector shelf 225 is horizontal, and is parallel with the frame arms 205, but the shelf 225 also may be angled slightly upward to help achieve a desired spray pattern.

Figure 4:
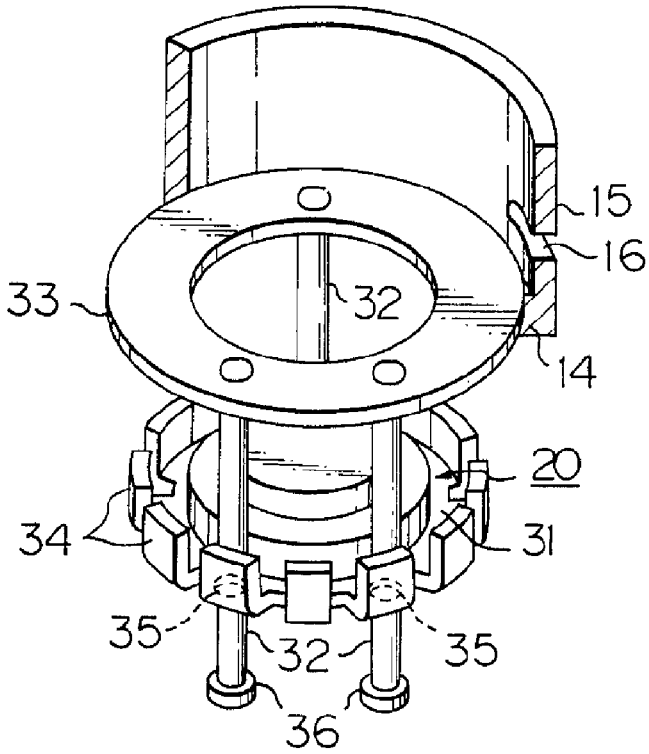
FIG. 4 is an isometric view of the horizontal sidewall sprinkler deflector.
Figure 5A:
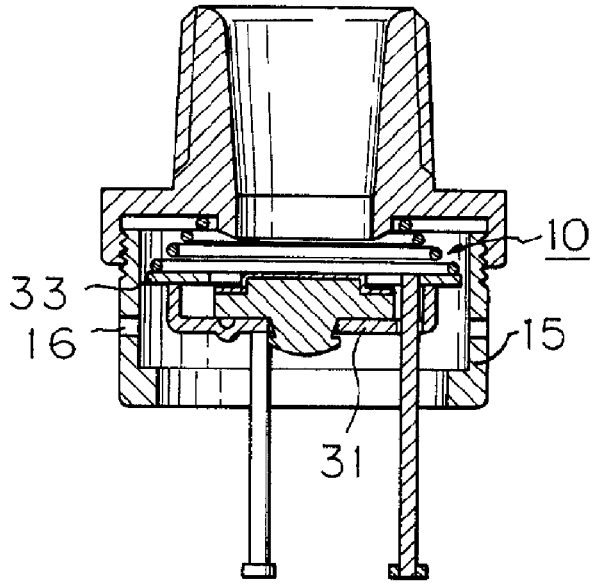
FIG. 5 is a rear plan view of the deflector.
Figure 5B:
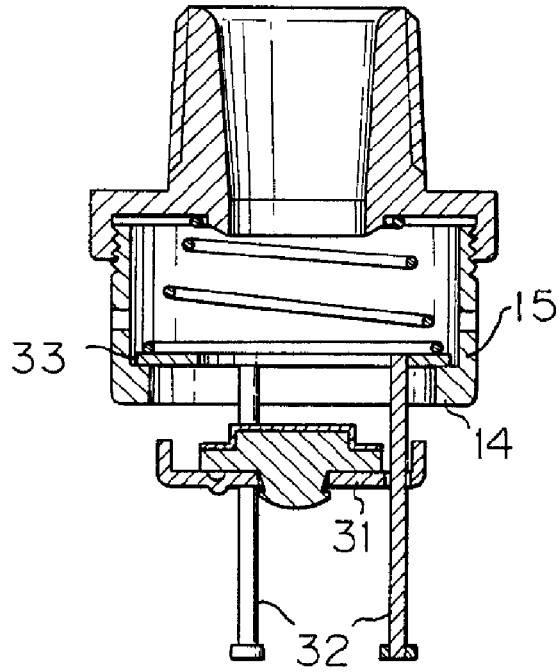
Figure 6:
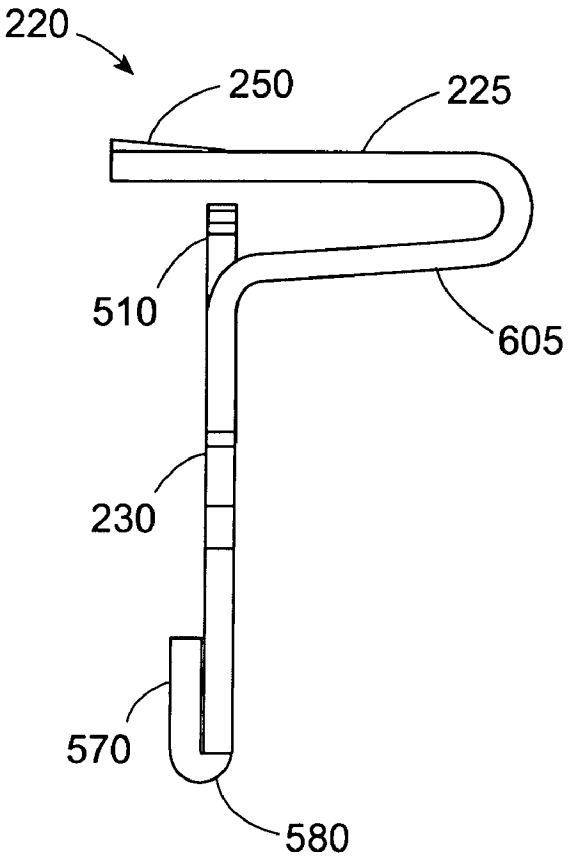
FIG. 6 is a side plan view of the deflector.
Figure 5:
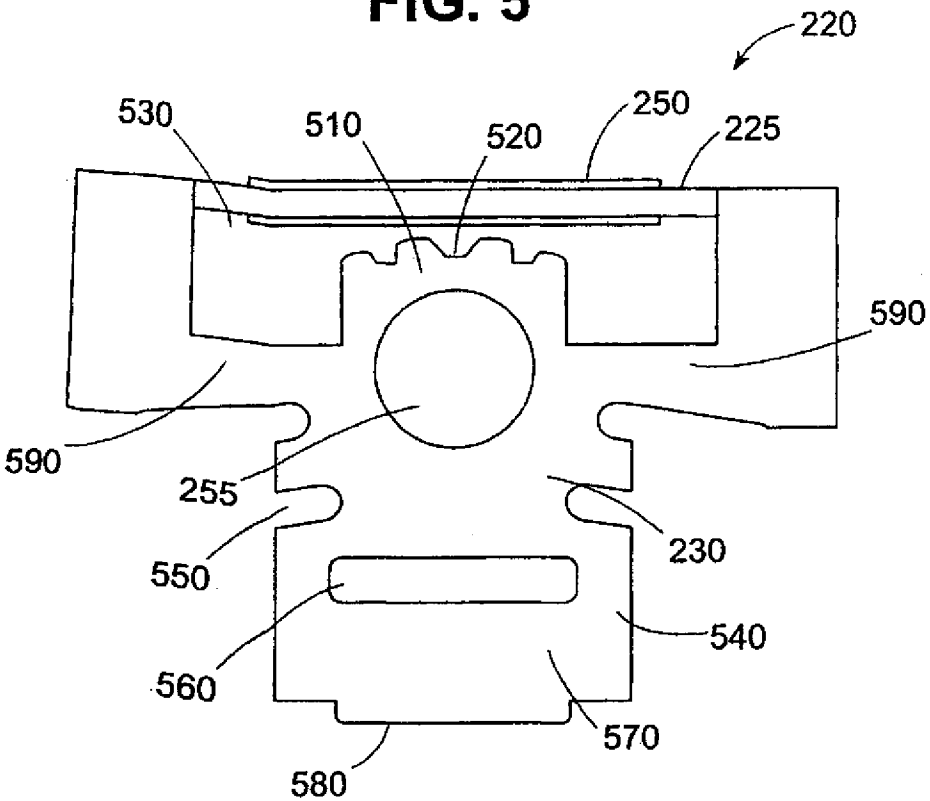
Figure 7:
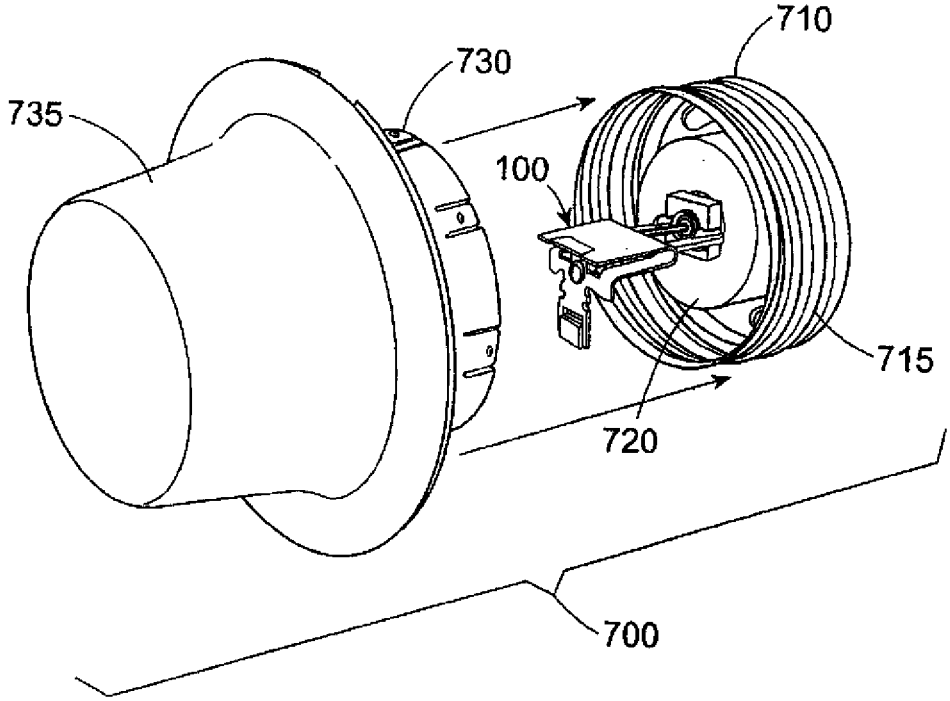
Figure 10:
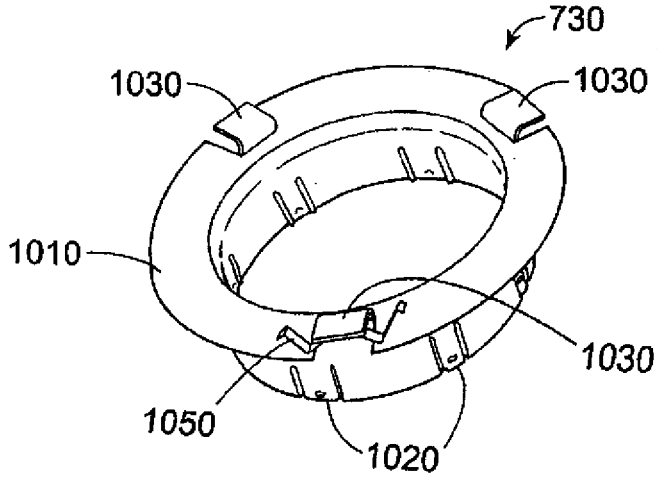
Figure 8:
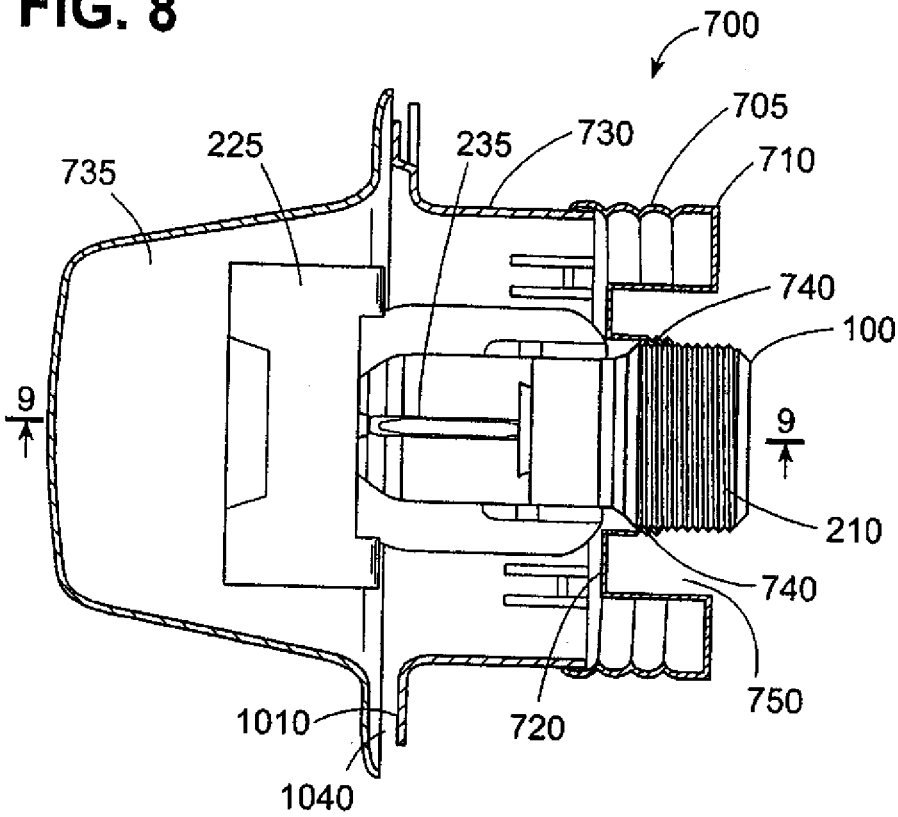
Figure 9:
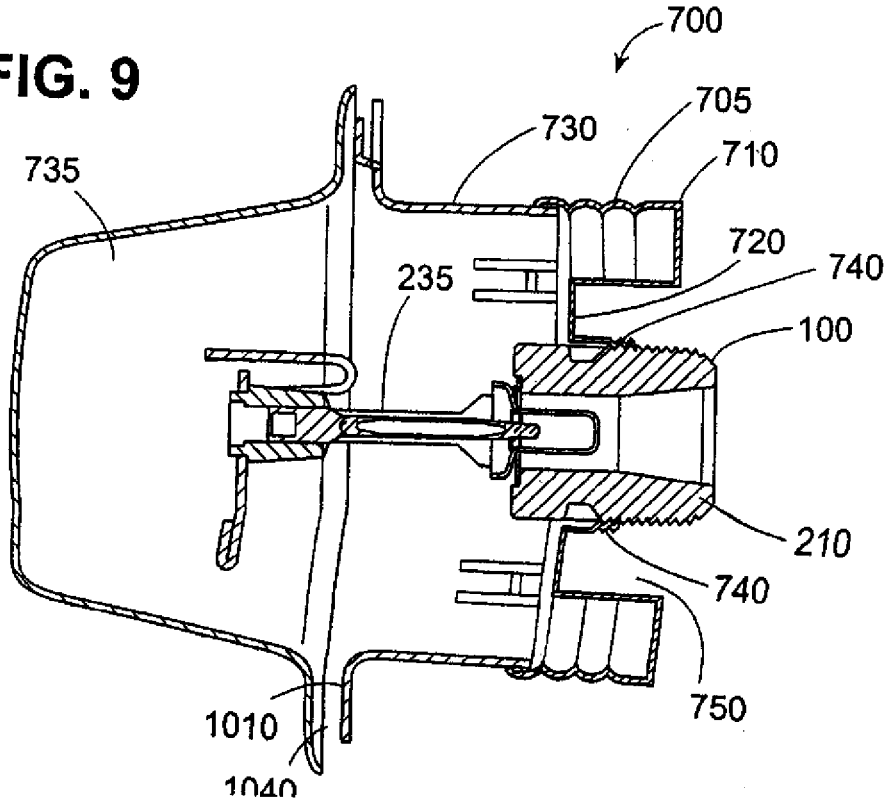
Figure 11:
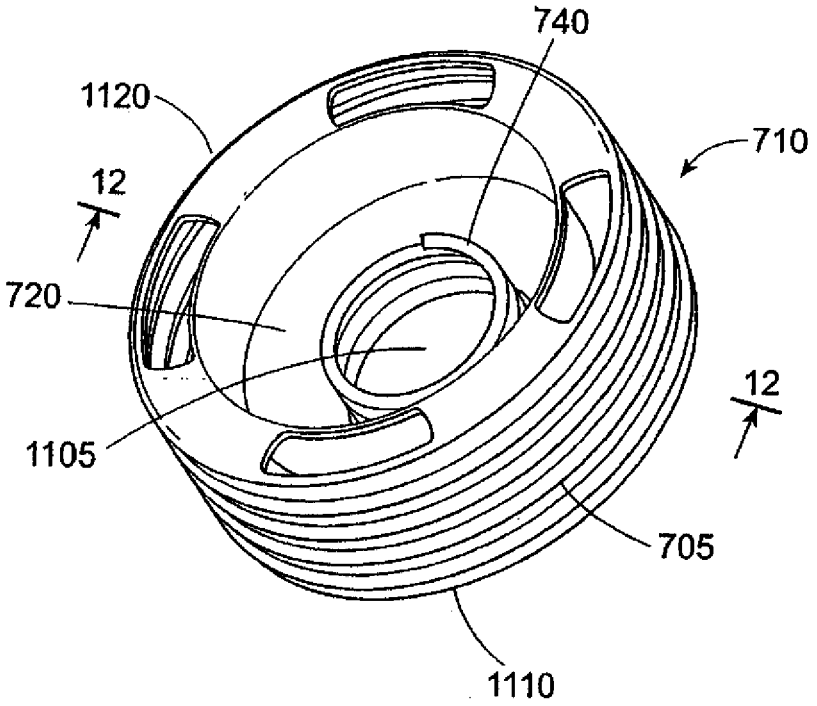
Figure 12:
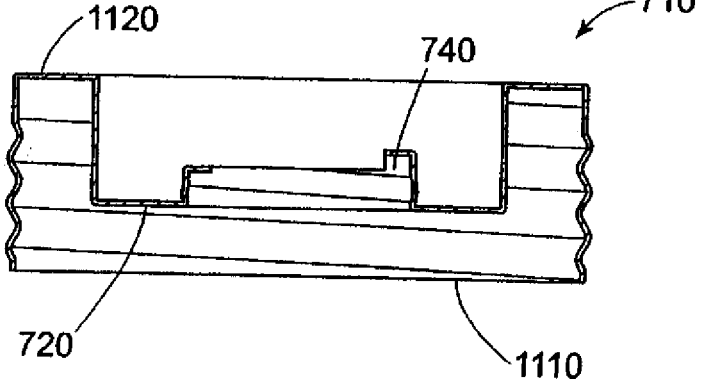

The deflector 220, as shown in FIGS. 4-6, may be formed by a stamping a thin piece of metal to form a flat blank (not shown) having a desired outer shape, with internal cut-outs. For example, the blank may be formed of brass, or brass alloy, and may for example be about 0.05 inches thick. The blank is folded to achieve the final shape of the deflector 220, including the horizontal shelf 225. As noted above, the vertical face 230 of the deflector 220 has an opening 255 in a central portion thereof to receive the fastener that attaches it to the hub 215 (see FIG. 3). Above the fastener opening 255 is an upper portion 510 of the vertical face 230 with notches 520 (see FIG. 5) formed on the edge thereof. A portion of the output fluid flows through the opening 530 formed between the upper portion 510 of the vertical face 230 and the bottom of the shelf 225 and is dispersed by the notches 520 to help achieve a desired spray pattern.

The vertical face 230 also has a lower portion 540 extending below the fastener opening 255. The lower portion 540 is generally rectangular with notches 550 formed on the sides and a rectangular window 560 formed near the bottom of the lower portion 540 that allows a portion of the output fluid to pass through. The bottom edge of the lower portion 540 has a folded portion 570 below the window 560 that provides a thicker, more rounded bottom edge 580 to the lower portion 540. The folded portion 570 is formed, for example, by folding a tab provided in the flat blank. This configuration helps reduce the dispersive edge effects of the bottom edge 580, which may cause fluid to spray back toward the sprinkler. Thus, the window 560 and folded portion 570 help to project more fluid in front of the plane of the vertical face 230 and also help to create a more uniform spray pattern on the floor. This in turn helps the sprinkler meet floor collection (i.e., density) requirements.

Two arm portions 590 of the deflector, which extend from the sides of the fastener opening 255, are formed in the fabrication process discussed above by cutting out an opening 530 in the flat blank between the shelf 225 and the vertical face 230. The arm portions 590 extend in the plane of the vertical face 230 and then, as shown in the side view of FIG. 6, bend approximately 85° to form two backwardly extending (i.e., toward the base of the sprinkler) arm portions 605 in a horizontal plane approximately parallel to the shelf 225. These backwardly extending arm portions 605 then bend to form part of the back edge of the deflector shelf 225. The shelf 225 forms an angle of about 90° with respect to the vertical face 230 and about 185° with respect to the backwardly extending arm portions 605. In addition, the tab of the folded portion 570 at the bottom of the vertical face forms an angle of about 2° with respect to the vertical face 230.

FIG. 6 also shows that the majority of the length of the deflector shelf 225 (as measured in the generally horizontal direction of fluid output) is rearwardly positioned with respect to the vertical face 230 of the deflector 220. In other words, the portion of the shelf 225 extending in front of the vertical face 230 of the deflector is less than about 50% of the total length of the shelf. For example, the shelf 225 may have a length of about 0.65 inches, but may extend forward beyond the vertical face 230 of the deflector by only about 0.23 inches. In such a case, the forwardly-extended portion of the shelf would be only about 35% of the total length of the shelf. Other proportions also are possible. For example, the forwardly-extended portion of the shelf may be about one third or less of the total length. Thus, the shelf 225 is "shorter" than a conventional horizontal sidewall design, in the sense that it does not extend as far forward beyond the vertical face 230 of the deflector 220.

The shorter shelf 225 results in less bending stress and greater stability for the deflector 220, while maintaining the required spray pattern. The shorter shelf also results a shorter overall length for the sprinkler 100, which helps reduce the risk of damage to installed units and improves the aesthetic characteristics of the sprinkler. In addition, as discussed below, the shorter shelf allows for the use of a lower-profile cover in the concealed configuration (i.e., a cover that is narrower and/or does not extend as far from the wall surface).

Figure 7:
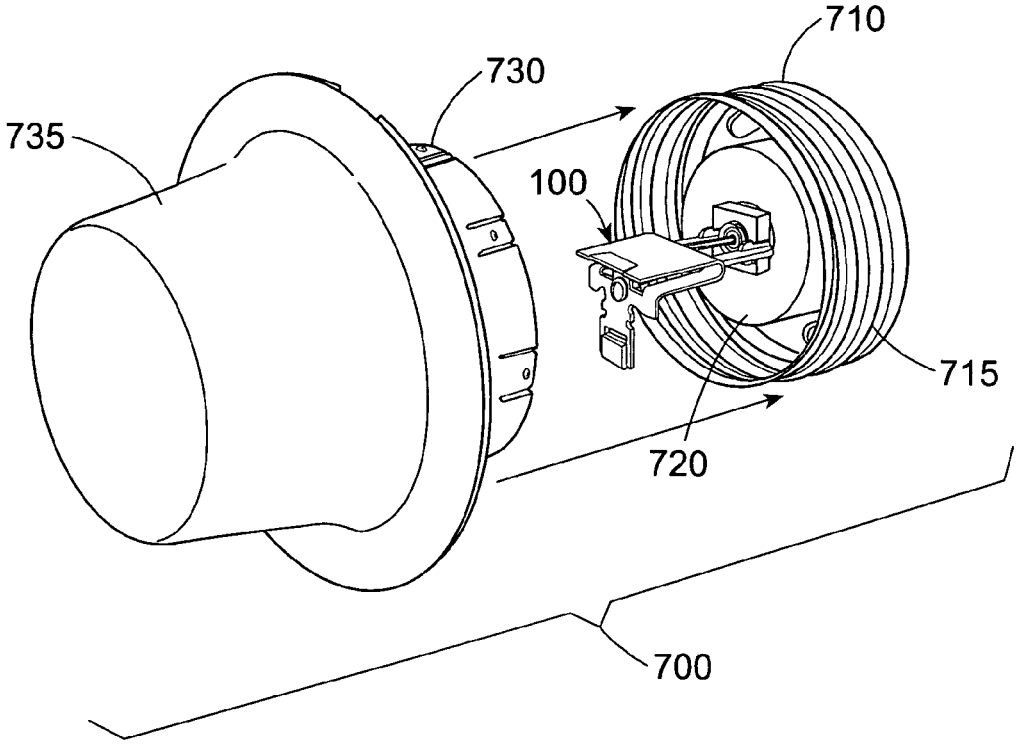
FIG. 7 is a perspective exploded view of the horizontal sidewall sprinkler installed in a support cup/cover assembly of a concealed configuration.

In an alternative embodiment, as shown in FIG. 7, the sprinkler 100 depicted in FIGS. 2-6 may be mounted in a concealed configuration in a support cup/cover assembly 700. The support cup 710 is generally circular, with a cylindrical, ridged outer surface 715 around its circumference and a raised mounting platform 720 positioned in its central portion. The cup 700 is configured to be mounted in a cavity in a wall, a predetermined distance below the ceiling. The sprinkler 100 is mounted in, and extends horizontally, from the platform 720 in the center of the support cup 700. An escutcheon 730 and cover 735 assembly, discussed in further detail below, is placed over the sprinkler 100 to protect it from damage and provide an aesthetically pleasing appearance.

Figure 8:
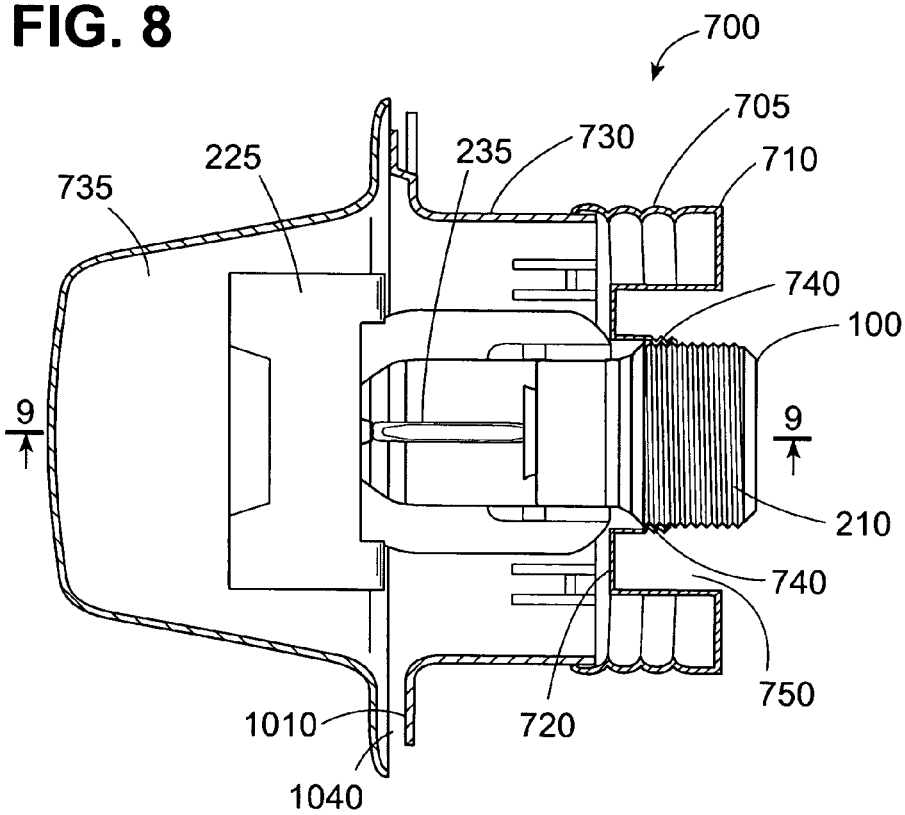
FIG. 8 is a top sectional view of the support cup/cover assembly of the concealed configuration, showing the sprinkler mounted therein.
Figure 9:
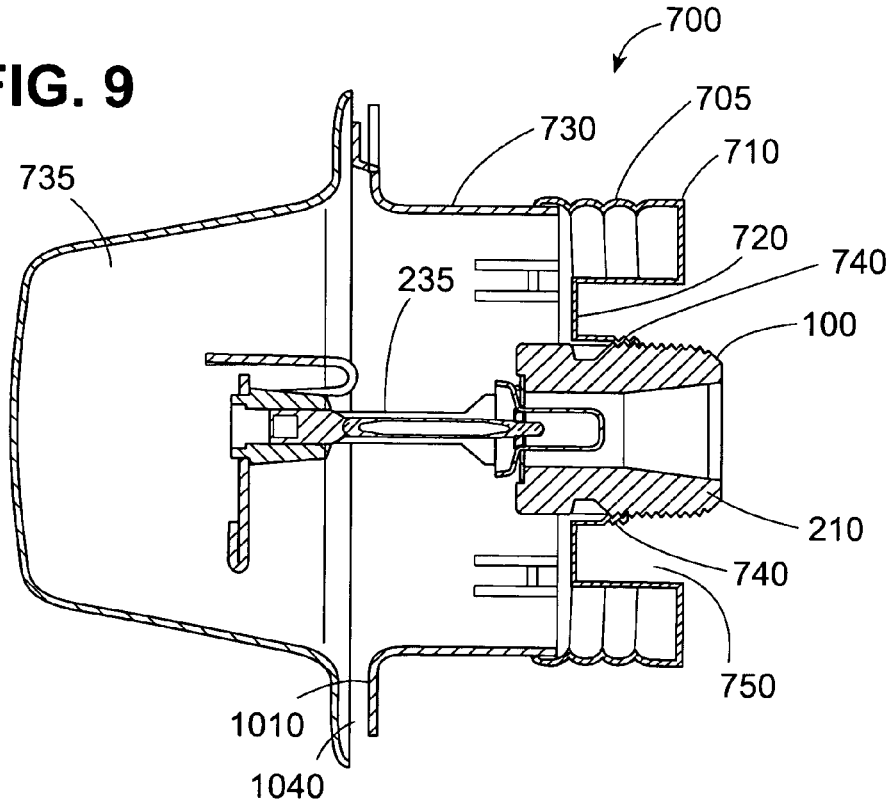
FIG. 9 is a side sectional view of the support cup/cover assembly of the concealed configuration, showing a side sectional view of the sprinkler.

FIG. 8 shows a top sectional view (looking down on the upper surface of the deflector shelf 225) of the support cup/cover assembly 700 with the sprinkler 100 installed. FIG. 9 shows a side sectional view of this assembly, with the sprinkler 100 shown in section. The cup 710, as noted above, has a ridged outer surface 705 around its circumference and a raised mounting platform 720 in the center. The sprinkler 100 is mounted in the platform 720 by screwing the threaded base portion 210 into an opening in the center of the platform 720. The opening has an inwardly-extended, threaded rim 740 (as shown) or alternatively, tabs, that act as thread guides to interlock with the threaded base portion 210 to hold the sprinkler 100 in place. The mounting platform 720 has a significantly larger radius that the base portion 210 of the sprinkler 100, so as to leave an annular volume 750 around the base 210, to allow sufficient room for connection of the sprinkler to the output head of the conduit.

Figure 10:
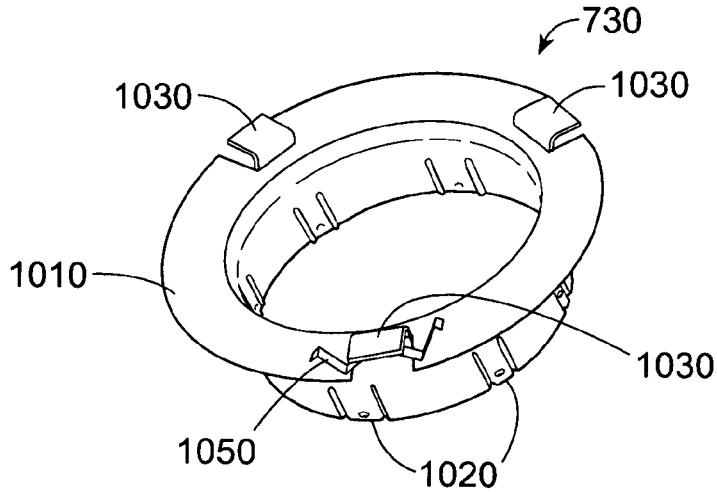
FIG. 10 is a perspective view of the escutcheon.

A portion of the sprinkler 100 is surrounded by a cylindrical escutcheon 730. As shown in FIG. 10, the escutcheon 730 has a circumferential flange 1010 on its outwardly facing end. The escutcheon 730 installs with a press fit into the ridged outer surface 705 of the support cup 710 (see FIGS. 8 and 9), so that the flange 1010 rests on the outer surface of the wall in which the cup 710 is installed. The escutcheon 730 may be formed, for example, of metal, e.g., steel or brass, having a thickness of about 0.020 inches. The escutcheon 730 has tabs 1020 located on the cup-installation edge of the cylindrical portion, order to act as stops to ensure the escutcheon 730 is not inserted into the cup 710 beyond a desired depth.

The escutcheon flange 1010 includes raised portions 1030 around its periphery that act as mounting points for the cover 735. The cover 735 is connected to these raised portions 1030, resulting in a gap 1040 (see FIGS. 8 and 9) being formed between the cover 735 and the escutcheon 730, which allows air flow to reach the sprinkler 100. The cover 735 is attached to these mounting points 1030 with solder that is designed to melt at a predetermined temperature to allow for release of the cover 735. Small springs 1050 formed of thin, bent metal tabs (only one of which is depicted), or similar spring structures, may be installed at the mounting points 1030 to urge the cover 735 away from the flange 1010, to help insure proper ejection of the cover 735.

Figure 11:
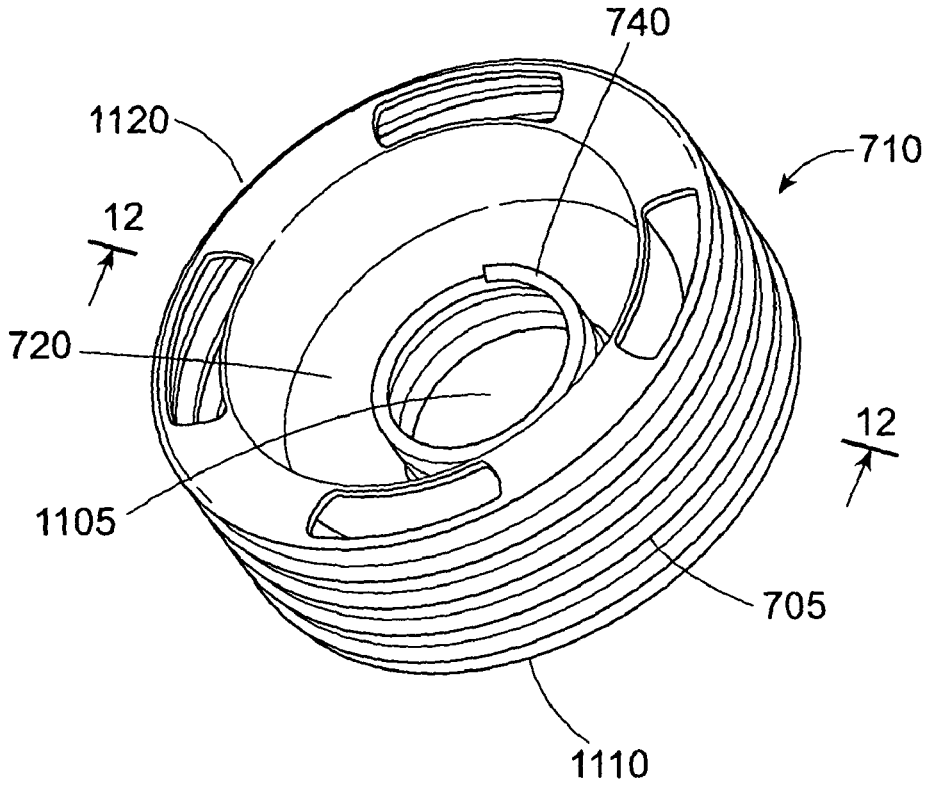
FIG. 11 is a rear isometric view of the support cup of the concealed configuration.
Figure 12:
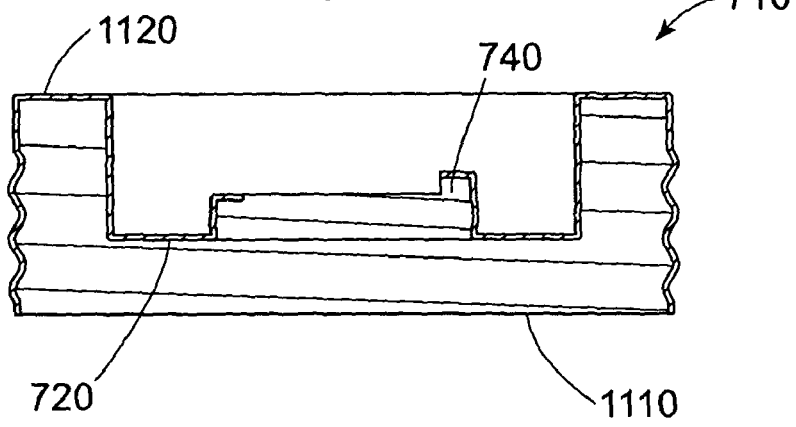
FIG. 12 is a side sectional view of the support cup of the concealed configuration.
Figure 1:
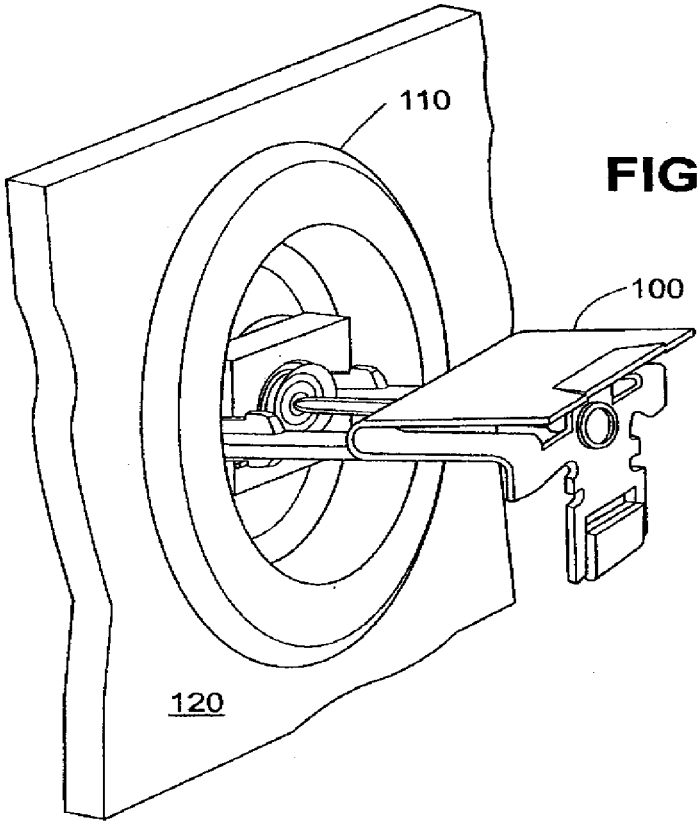
Figure 4:
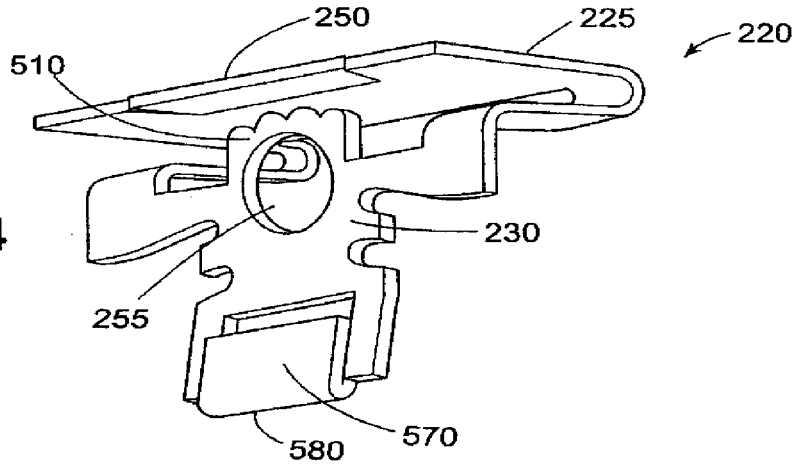
Figure 2:
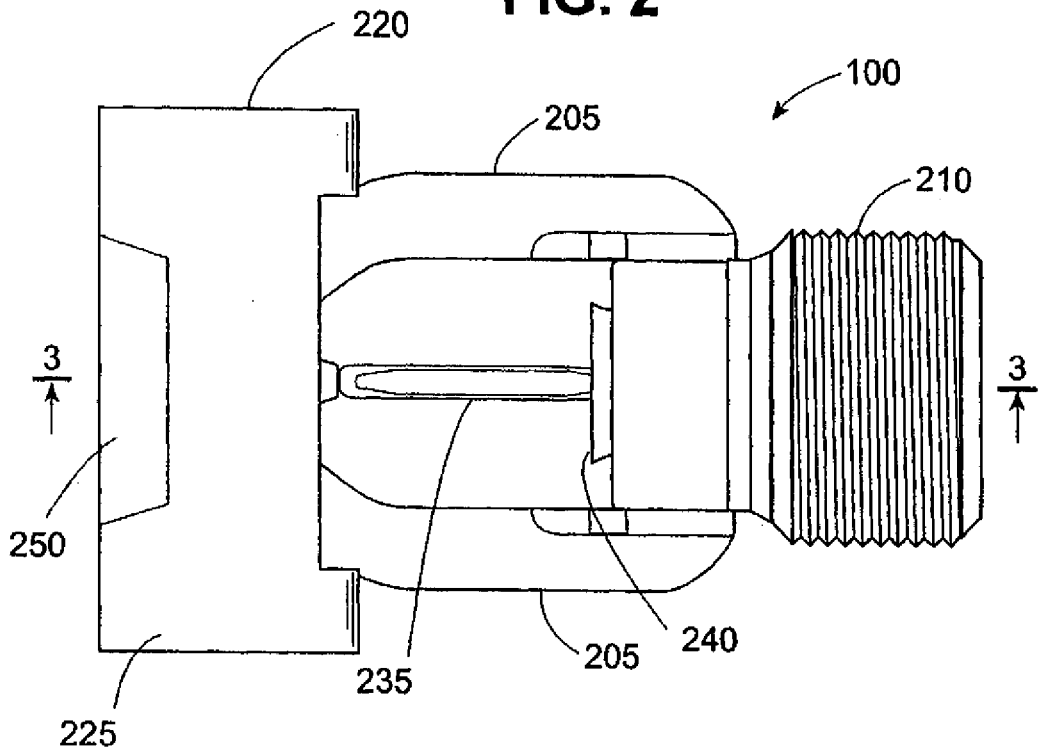
Figure 3:
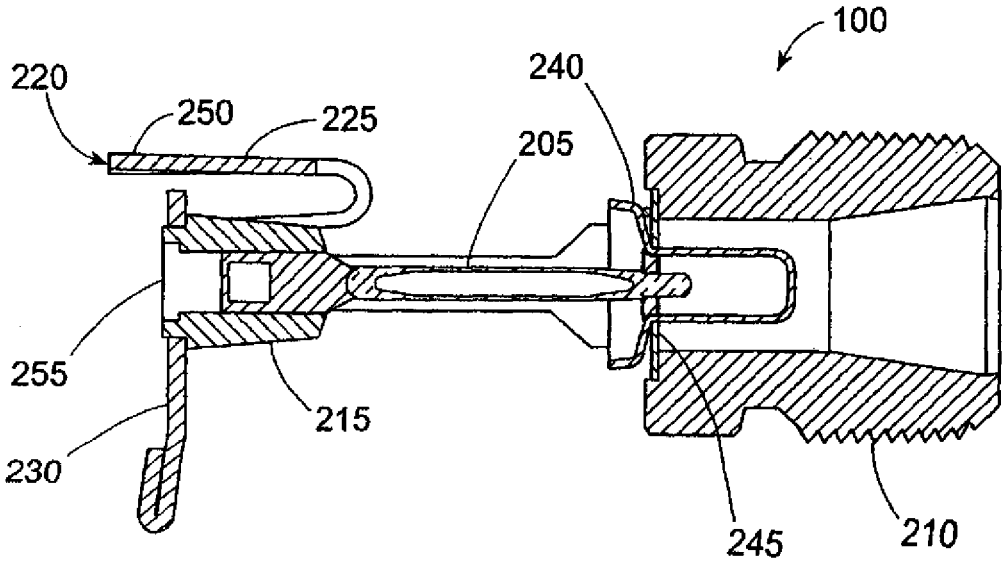
Figure 6:
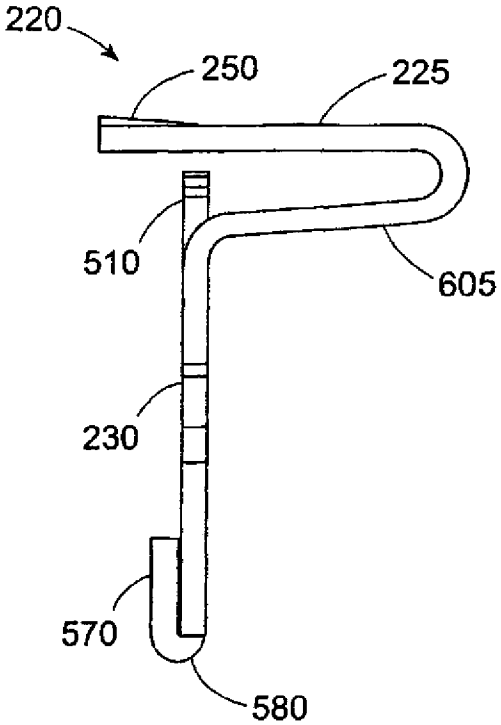

FIG. 11 is a rear isometric view of the support cup 710 for the concealed configuration, i.e., a view from the side opposite that from which the sprinkler extends. FIG. 12 is a side sectional view oriented so that the installed sprinkler would extend downward with respect to the drawing sheet. As noted above, the sprinkler 100 is installed in a mounting platform 720 in the central portion of the support cup 710 (see FIGS. 8 and 9). The threaded base portion 210 of the sprinkler 100 fits within an opening 1105 in the mounting platform 720 and interlocks with a threaded rim 740 within the opening 1105. The mounting platform 720 is forwardly-extended, such that the surface of the mounting platform 720 is closer to the forward facing edge 1110 of the support cup 710 than the rear edge 1120 in the axial direction. For example, the distance from the surface of the mounting platform 720 to the forward edge 1110 of the support cup 710 may be about 0.25 inches, while the distance to the rear edge 1120 may be about 0.5 inches.

The forwardly-extended mounting platform 720 arrangement results in the sprinkler 100 being positioned so that the thermally-responsive element 235 extends beyond the wall plane, i.e., beyond the rim 1010 of the escutcheon 730. In other words, the thermally-responsive element 235 extends into the gap 1040 between the escutcheon 730 and the cover 735 (see FIGS. 8 and 9), in the generally horizontal direction, and may extend at least partially into the cover 735. Such an arrangement is advantageous in that the thermally-responsive element 235 is more exposed to the air flow entering the assembly through the gap 1040 between the cover 735 and the escutcheon 730, resulting in improved responsiveness of the sprinkler. This advantage is particularly important for applications requiring faster response time, such as residential applications.

The support cup/cover assembly described above also may be used in conjunction with pendent sprinklers. For example, a pendent sprinkler may be mounted in the support cup installed in a ceiling. The escutcheon/cover assembly is inserted into the support cup so that the flange of the escutcheon is flush with the ceiling. The pendent sprinkler may have arms that meet at a hub, to which a deflector is attached. Alternatively, the pendent sprinkler may be a "frameless" sprinkler, which does not have arms and a hub, but instead has a thermally-responsive element releasably mounted on the sprinkler body to hold the seal cap in place and a drop-down deflector.

In addition, the support cup described above may be used with other types of escutcheons and covers, or without a cover, in either a horizontal or pendent configuration. For example, a pendent sprinkler may be mounted in the support cup, as described above, mounted in a ceiling. In such a case, the sprinkler would be positioned so that its thermally-responsive element would be more exposed to air flow, due to the forwardly-extended mounting platform in the support cup.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A fire protection sprinkler comprising:

a body, including an output orifice sealed with a seal cap and a base portion including an input orifice;

a thermally-responsive element positioned to releasably retain the seal cap;

a deflector positioned a distance from the output orifice in a direction of fluid flow; and a support including an outer support cup and an inner mounting cup connected to the support cup, wherein the support cup has a front edge in the fluid flow direction and has a rear edge and has an outer base at the rear edge, and wherein the mounting cup has an inner base in the fluid flow direction and a rear edge connected to the outer base, the inner base being configured as a mounting platform that receives the base portion of the body through a through opening in the mounting platform such that the body extends through the opening so that the output orifice and the input orifice are disposed on opposite sides of the mounting platform, and wherein the mounting platform is closer to the front edge of the support cup in an axial direction thereof than to the rear edge of the support cup.

2. The fire protection sprinkler of claim 1, wherein the mounting platform is spaced from both the front edge and the rear edge of the support cup in the axial direction, and is spaced from the rear edge by at least about twice as great a distance as from the front edge of the support cup.

3. The fire protection sprinkler of claim 1, wherein the raised mounting platform is between and spaced from the front edge and the rear edge.

4. The fire protection sprinkler of claim 1, wherein the mounting base is configured to transversely space the body from the mounting cup.

5. A fire protection sprinkler comprising:

a body, including an output orifice sealed with a seal cap and a base portion including an input orifice;

a thermally-responsive element positioned to releasably retain the seal cap;

a deflector positioned a distance from the output orifice in a direction of fluid flow;

a support cup having a raised mounting platform configured to receive the base portion of the body through a through opening in the mounting platform such that the body extends through the opening so that the output orifice and the input orifice are disposed on opposite sides of the mounting platform, the support cup having a substantially cylindrical outer surface, a front edge in the fluid flow direction, and a back edge, wherein the mounting platform is closer to the front edge of the support cup in an axial direction thereof than to the back edge of the support cup; and an escutcheon having a rear end and a front end and having a substantially cylindrical outer surface extending from the rear end to the front end, and having a mounting flange attached to the front end, wherein the rear end is configured to fit inside the outer surface of the support cup, and wherein the front end is positioned in the direction of fluid flow.

6. The fire protection sprinkler of claim 5, further comprising a cover attached to a mounting flange of the escutcheon.

7. A fire protection sprinkler comprising:

a body, including an output orifice sealed with a seal cap;

a thermally-responsive element positioned to releasably retain the seal cap;

a deflector positioned a distance from the output orifice in a direction of fluid flow; and a support including an outer cylindrical support cup and an inner cylindrical mounting cup connected to the support cup, wherein the support cup has a front edge in the fluid flow direction and has a rear edge and has an outer base at the rear edge, and wherein the mounting cup has an inner base in the fluid flow direction and a rear edge connected to the outer base, the inner base being configured as a mounting platform that receives the body, and wherein the mounting platform is closer to the front edge of the support cup in an axial direction thereof than to the rear edge of the support cup, and wherein an annular volume is defined between the support cup and the mounting cup, and wherein the support cup has a substantially cylindrical outer surface of a first diameter, and the raised mounting platform is located within the outer surface of the support cup and has an outer diameter that is less than the first diameter.

* * * * *

UNITED STATES PATENT AND TRADEMARK OFFICE

CERTIFICATE OF CORRECTION

PATENT NO. : 7,784,555 B2
APPLICATION NO. : 10/974397
DATED : August 31, 2010
INVENTOR(S) : Oliver S. Pahila It is certified that error appears in the above-identified patent and that said Letters Patent is hereby corrected as shown below:

Delete Sheets 1 of 8 through 8 of 8 and replace with the following set of six (6) drawing sheets.

Signed and Sealed this
First Day of March, 2011

David J. Kappos

David J. Kappos
*Director of the United States Patent and Trademark Office*